US008577241B2

(12) United States Patent
Uehara

(10) Patent No.: US 8,577,241 B2
(45) Date of Patent: Nov. 5, 2013

(54) IMAGE FORMING APPARATUS AND CONTROL METHOD THEREOF THAT SEPARATE ROLLER BODIES AFTER A PREDETERMINED TIME ELAPSES AFTER BEING IN A POWER SAVE MODE

(75) Inventor: Takashi Uehara, Toride (JP)

(73) Assignee: Canon Kabushiki Kaisha (JP)

( * ) Notice: Subject to any disclaimer, the term of this patent is extended or adjusted under 35 U.S.C. 154(b) by 628 days.

(21) Appl. No.: 12/199,426

(22) Filed: Aug. 27, 2008

(65) Prior Publication Data

US 2009/0060558 A1 Mar. 5, 2009

(30) Foreign Application Priority Data

Aug. 30, 2007 (JP) ..... 2007-224554

(51) Int. Cl.
*G03G 15/00* (2006.01)
*G03G 15/20* (2006.01)

(52) U.S. Cl.
USPC ..... 399/88; 399/33

(58) Field of Classification Search
USPC ..... 399/33, 67, 320, 324, 328, 335, 338, 399/88, 43
See application file for complete search history.

(56) References Cited

U.S. PATENT DOCUMENTS 5,887,236 A * 3/1999 Hirao et al. ..... 399/330
6,681,088 B2 1/2004 Kanno et al.
2006/0029442 A1* 2/2006 Ide ..... 399/327
2006/0034626 A1* 2/2006 Tanaka ..... 399/12
2007/0002383 A1* 1/2007 Ohmiya et al. ..... 358/3.12

FOREIGN PATENT DOCUMENTS

JP 04-140769 A 5/1992
JP 06-161237 A 6/1994
JP 11-095516 A 4/1999
JP 11-153896 A 6/1999
JP 2000-122460 A 4/2000
JP 2003-167499 A 6/2003
JP 2003-216001 A 7/2003
JP 2005-099252 A 4/2005
JP 2006-292868 A 10/2006
JP 2007-156225 A 6/2007

OTHER PUBLICATIONS

Japanese Office Action issued in counterpart application No. JP2007-224554, dated Apr. 17, 2012.

* cited by examiner

*Primary Examiner* — Billy J Lactaoen
(74) *Attorney, Agent, or Firm* — Rossi, Kimms & McDowell LLP

(57) ABSTRACT

An image forming apparatus which is capable of reducing the number of times a second member is separated from a first member upon entry into power-save mode, thereby minimizing failures of a separation unit. A pressure-roller separating mechanism is provided so as to abut and separate a pressure roller and a fixing roller against/from each other. The image forming apparatus is controlled to change to a power-save mode in which power consumption of the image forming apparatus is reduced. The pressure-roller separating mechanism is controlled to separate the pressure roller and the fixing roller from each other in the power-save mode based on a measurement result measured by a timer, and the power-save mode is maintained after the pressure roller and the fixing roller are separated from each other.

14 Claims, 7 Drawing Sheets

IMAGE FORMING APPARATUS AND CONTROL METHOD THEREOF THAT SEPARATE ROLLER BODIES AFTER A PREDETERMINED TIME ELAPSES AFTER BEING IN A POWER SAVE MODE

BACKGROUND OF THE INVENTION

1. Field of the Invention

The present invention relates to an image forming apparatus and a control method thereof.

2. Description of the Related Art

In an image forming apparatus such as a laser beam printer which uses electrophotographic method, a photosensitive drum is exposure-scanned with a laser beam and consequently a latent image is formed on the photosensitive drum. The latent image is visualized as a toner image with toner supplied from a developing unit. The toner image on the photosensitive drum is transferred by a transferring unit onto sheet fed from a sheet cassette. The sheet onto which the toner image has been transferred is heated and pressed by a fixing unit and consequently the toner image is fixed on the sheet. Then, the sheet is discharged out of the apparatus.

Examples of the fixing unit include a type which comprises a fixing roller having an elastic layer formed thereon, a pressure roller having an elastic layer formed thereon, and a heater incorporated in the fixing roller. In the fixing unit of this type, the fixing roller and pressure roller abut each other at a predetermined pressure. Consequently, a nip is formed between the fixing roller and pressure roller to nip and transport the sheet. Also, during image formation, the nip is kept at a fixable temperature by the heater incorporated in the fixing roller. Thus, when the sheet is passing through the nip, the sheet is heated and pressed together with the toner image.

If the fixing roller and pressure roller remain abutted against each other when no image forming operation is going on, abutting portions of the elastic layers become deformed and when an image forming operation is started, the deformed portions of the elastic layers may not return to their original state. Consequently, an appropriate heat quantity may not be transmitted from the deformed portions of the elastic layers to the toner image on the sheet, making reflectivity of a fixed image nonuniform and resulting in degradation of image quality.

To deal with this, a mechanism has been proposed which separates the fixing roller and the pressure roller from each other using an auxiliary member when the image forming operation is stopped (see, for example, Japanese Laid-Open Patent Publication (Kokai) No. 2000-122460).

Examples of the transferring unit include a type which comprises a sheet conveying belt adapted to carry and transport a sheet and a transfer roller disposed opposite to the photosensitive drum across the sheet conveying belt. In the transferring unit of this type, the transfer roller is pressed against the photosensitive drum via the sheet conveying belt. Consequently, a nip is formed between the photosensitive drum and sheet conveying belt to nip and transport the sheet.

If the transfer roller remains pressed against the photosensitive drum via the sheet conveying belt when no image forming operation is going on, compressive force is applied to the transfer roller and sheet conveying belt. This may cause deformation to surface layers of the transfer roller and sheet conveying belt. Consequently, when a next image forming operation is started, sheet transport will become unstable depending on magnitude of the deformation. This may degrade image quality.

To deal with this, a mechanism has been proposed which separates the transfer roller and photosensitive drum from each other using an auxiliary member when the image forming operation is stopped (see, for example, Japanese Laid-Open Patent Publication (Kokai) No. 11-153896).

Examples of the developing unit include a type which comprises a developing roller having an elastic layer formed thereon and urged so as to abut the photosensitive drum. In the developing unit of this type, since the developing roller abuts the photosensitive drum, the elastic layer formed on the developing roller deforms. If the developing roller and photosensitive drum remain abutted against each other for an extended period of time when no image forming operation is going on, the deformed elastic layer of the developing roller will not return to its original state at the time of development. This may cause variations in an image.

To deal with this, a mechanism has been proposed which separates the photosensitive drum and developing roller from each other using an auxiliary member when the image forming operation is stopped (see, for example, Japanese Laid-Open Patent Publication (Kokai) No. 2003-167499).

Also, the image forming apparatus has a power-save mode to restrict (or stop or reduce) power supply to various parts of the apparatus. When a user selects the power-save mode or if next print data is not received until a predetermined time elapses after power-on or after the end of image formation, the power-save mode starts, restricting power supply to various parts of the apparatus. Also, when power supply to various parts of the image forming apparatus is restricted, if the user selects to cancel the power-save mode or if print data is received, the power-save mode is canceled. That is, the restriction of power supply to the various parts of the apparatus is lifted.

It is assumed that an image forming apparatus which has the power-save mode is provided with a mechanism for separating the fixing roller and the pressure roller, such as described above. In that case, when the image forming apparatus is changed to the power-save mode, the mechanism separates the fixing roller and the pressure roller from each other before power supply to various parts of the apparatus is restricted. Conversely, when the restriction of power supply to the various parts of the apparatus is lifted, the separation of the fixing roller and the pressure roller is cancelled and the fixing roller and the pressure roller return to their original state of abutment.

In some image forming apparatuses which have a power-save mode, such as described above, an interval between the end of an image forming operation and the start of power-save mode is set to a short time. Besides, there are cases in which the power-save mode is often selected by the user immediately after the end of an image forming operation. Also, there are cases in which print data is often received in a short period of time after the fixing roller and the pressure roller are separated. Also, there are cases in which the power-save mode is canceled by the user within a short period of time after the fixing roller and the pressure roller are separated.

In such cases, the fixing roller and the pressure roller are separated and abutted repeatedly in a short period of time. If the cycle of separation and abutment is repeated an increased number of times, it is highly likely that members (e.g., a cam, moving member, and the like) which constitute the mechanism for separating and abutting the fixing roller and the pressure roller will fail in a shorter period of time than the life of the image forming apparatus.

SUMMARY OF THE INVENTION

The present invention provides an image forming apparatus and a control method thereof, which are capable of reducing the number of times a second member is separated from a first member upon entry into power-save mode, thereby minimizing failures of a separation unit.

In a first aspect of the present invention, there is provided an image forming apparatus for forming an image on a sheet, comprising an abutting and separating unit adapted to abut and separate a first rotating body and a second rotating body against/from each other, a timer adapted to measure time, and a control unit adapted to cause the image forming apparatus to change to a power-save mode in which power consumption of the image forming apparatus is reduced, and the control unit is adapted to cause the abutting and separating unit to separate the first rotating body and the second rotating body from each other in the power-save mode based on a measurement result measured by the timer, and adapted to perform control so as to maintain the power-save mode after the first rotating body and the second rotating body are separated from each other.

In a second aspect of the present invention, there is provided a control method for an image forming apparatus that includes a first rotating body and a second rotating body disposed for abutment with and separation from the first rotating body, the control method comprising a first control step of causing the image forming apparatus to change to a power-save mode in which power consumption of the image forming apparatus is reduced, a measuring step of measuring time, a second control step of separating the first rotating body and the second rotating body from each other during the power-save mode based on measurement results measured by the measuring step, and a third control step of maintaining the power-save mode after the first rotating body and the second rotating body are separated from each other.

In a third aspect of the present invention, there is provided an image forming apparatus for performing an image forming operation with a first element and a second element abutting each other, comprising an abutting and separating unit adapted to abut and separate the first element and the second element against/from each other, a timer adapted to measure time, and a control unit adapted to cause the image forming apparatus to change to a power-save mode in which power consumption of the image forming apparatus is reduced, and the control unit is adapted to cause the abutting and separating unit to separate the first element and the second element from each other during the power-save mode based on a measurement result measured by the timer, and adapted to perform control so as to maintain the power-save mode after the first element and the second element are separated from each other.

According to the present invention, it is possible to reduce the number of times the second member is separated from the first member upon entry into power-save mode, to thereby minimize failures of the separation unit.

Further features and advantages of the present invention will become apparent from the following detailed description of exemplary embodiments with reference to the attached drawings.

DETAILED DESCRIPTION OF THE EMBODIMENTS

The present invention will now be described in detail with reference to the drawings showing a preferred embodiment thereof.

Figure 1:
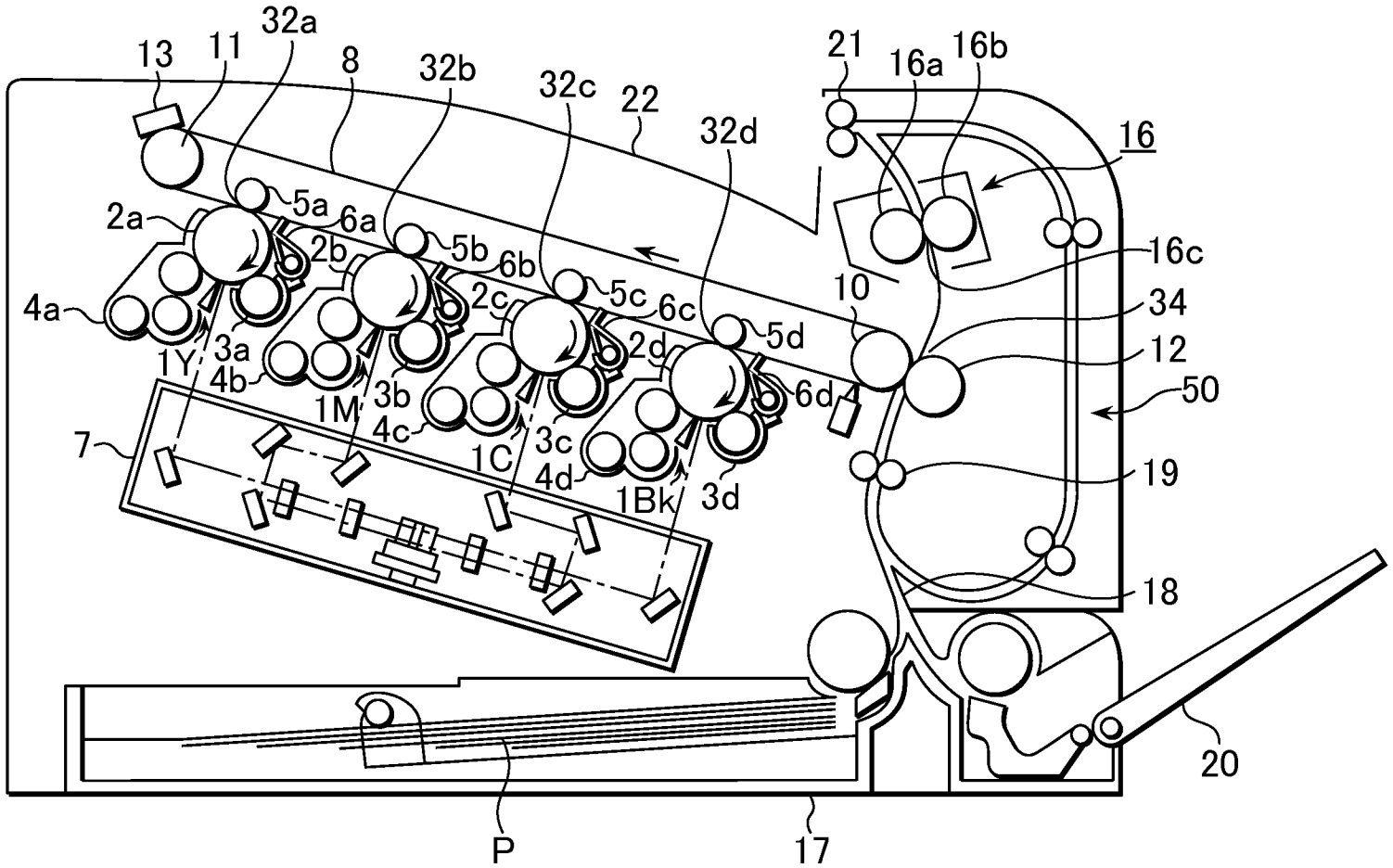
FIG. 1 is a longitudinal sectional view schematically showing a configuration of an image forming apparatus according to an embodiment of the present invention.

FIG. 1 is a longitudinal sectional view schematically showing a configuration of an image forming apparatus according to an embodiment of the present invention. According to the present embodiment, as an example of the image forming apparatus, an electrophotographic color image forming apparatus equipped with a tandem-drive intermediate transfer belt (intermediate transfer unit) will be described.

As shown in FIG. 1, the image forming apparatus according to the present embodiment is comprised of an image forming unit which forms images in yellow (Y), magenta (M), cyan (C), and black (Bk).

The image forming unit includes an image forming block 1Y which forms a yellow (Y) image, an image forming block 1M which forms a magenta (M) image, an image forming block 1C which forms a cyan (C) image, and an image forming block 1Bk which forms a black (Bk) image. The four image forming blocks 1Y, 1M, 1C, and 1Bk (which will be referred to collectively as the image forming block 1) are arranged in a row at predetermined intervals.

The image forming blocks 1Y, 1M, 1C, and 1Bk have respective photosensitive drums (photosensitive members) 2*a*, 2*b*, 2*c*, and 2*d* (which will be referred to collectively as the photosensitive drum 2). The photosensitive drums 2*a* to 2*d* are surrounded by respective primary chargers 3*a*, 3*b*, 3*c*, and 3*d* (which will be referred to collectively as the primary charger 3), developing units 4*a*, 4*b*, 4*c*, and 4*d* (which will be referred to collectively as the developing unit 4), transfer rollers 5*a*, 5*b*, 5*c*, and 5*d* (which will be referred to collectively as the transfer roller 5), and drum cleaners 6*a*, 6*b*, 6*c*, and 6*d* (which will be referred to collectively as the drum cleaner 6). Also, a laser unit 7 is installed to exposure-scan the photosensitive drums 2*a* to 2*d* with a laser beam.

The photosensitive drum 2, which is a negatively charged organic photosensitive member (OPC), includes an aluminum drum base body having a photoconductive layer formed thereon. The photosensitive drum 2 is rotationally driven clockwise by a drive (not shown) at a predetermined process speed. The primary chargers 3 charge surfaces of the respective photosensitive drums 2 uniformly to predetermined negative potentials with charging bias applied by respective charging bias supplies (not shown).

The laser unit 7 includes a laser emitter which emits light based on inputted image data, a polygonal mirror, a reflective mirror, and the like. The photosensitive drums 2 are exposure-scanned with the emitted laser beam. Consequently, latent images corresponding to the image information are formed on the surfaces of the photosensitive drums 2 charged by the primary chargers 3.

Each of the developing units 4*a* to 4*d* contains toner (a developer) of an appropriate color, i.e., one of yellow toner, cyan toner, magenta toner, and black toner. The developing unit 4 has the developing roller which supplies the toner to the photosensitive drum 2. The developing unit 4 is held in such a way that the developing roller will abut the photosensitive drum 2 (that clearance between the developing roller and photosensitive drum 2 will be very small). The developing unit 4 supplies toner to the photosensitive drum 2 as the developing roller rotates. The supplied toner causes the latent images formed on the photosensitive drums 2*a* to 2*d* to be developed (visualized) as toner images (developer images) in respective colors.

If the developing roller and photosensitive drum 2 remain abutted against each other for an extended period of time, part of the developer roller may become deformed, thereby failing to return to its original state. The developer roller with part of it deformed can cause image irregularities and sheet smudge when it rotates. Thus, a developer-roller separating mechanism described later (FIGS. 2, 5A, and 5B) is installed to prevent the developer roller from being deformed and failing to return to its original state.

An elastic material layer is formed on the transfer roller 5. The transfer roller 5 is installed, being pressed against the photosensitive drum 2 via an intermediate transfer belt 8. Consequently, the photosensitive drums 2*a* to 2*d* abut the intermediate transfer belt 8, forming nips 32*a* to 32*d* (which will be referred to collectively as the nip 32). The transfer roller 5 and intermediate transfer belt 8 rotate in the direction opposite to the photosensitive drum 2. That is, in the nips 32*a* to 32*d*, the toner images on the photosensitive drums 2*a* to 2*d* are transferred onto the intermediate transfer belt 8 by the transfer rollers 5*a* to 5*d*, being superimposed one on top of another. The transfer rollers 5 and intermediate transfer belt 8 constitute a primary transfer unit.

If the transfer rollers 5 and photosensitive drum 2 remain abutted against each other for an extended period of time, the elastic material layers of the transfer rollers 5 may become partly deformed, thereby failing to return to their original state. The transfer rollers, if rotated in this state, will cause transfer variations (irregularities). To prevent this, a transfer-roller separating mechanism described later (FIGS. 2 and 4) is installed.

The intermediate transfer belt 8 is disposed above the photosensitive drum 2, being worn on between a secondary transfer counter roller 10 and a tension roller 11. The secondary transfer counter roller 10 is installed, being pressed against a secondary transfer roller 12 via the intermediate transfer belt 8 and thereby forming a nip 34. The intermediate transfer belt 8 is made of dielectric resin film such as polycarbonate, polyethylene terephthalate, or polyvinylidene fluoride resin film.

The toner image transferred onto the intermediate transfer belt 8 is transferred, in the nip 34, onto sheet P fed from a sheet feed unit described later. The intermediate transfer belt 8 and secondary transfer roller 12 make up a secondary transfer unit. A belt cleaning apparatus 13 is installed near the tension roller 11 to remove and recover any toner remaining on a surface of the intermediate transfer belt 8.

The drum cleaner 6 has a cleaning blade (not shown) which is used to scrape off and recover any toner remaining on the photosensitive drum 2 without being transferred onto the intermediate transfer belt 8, from a surface of the photosensitive drum 2.

The sheet feed unit includes a sheet cassette 17 and a manual feed tray 20. The sheet cassette 17 contains the sheet P in a bundle and the sheet P is sent out sheet by sheet by a pickup roller (not shown). The sheet P sent out passes through a sheet feed roller and a sheet guide 18, reaches registration rollers 19, and stops there temporarily. Then, the sheet P is sent out to the nip 34 by the registration rollers 19, being timed with image formation.

The manual feed tray 20 feeds the sheet P sheet by sheet. The sheet P mounted on the manual feed tray 20 is fed toward the registration rollers 19 as in the case of sheet (P) feeding from the sheet cassette 17. Then, the sheet P is sent out to the nip 34 by the registration rollers 19, being timed with image formation.

After the toner image is transferred to the sheet P in the nip 34, the sheet P is sent to a fixing unit 16. The fixing unit 16 has a fixing roller 16*a* formed into a cylindrical shape from a film material and a pressure roller 16*b* covered with an elastic material layer. A heater (not shown) is incorporated in the fixing roller 16*a*. The fixing roller 16*a* and pressure roller 16*b* abut each other at a predetermined pressure, with a nip 16*c* formed between them to nip and transport the sheet. When the sheet P passes through the nip 16*c*, the sheet P is heated and pressed, and consequently, the toner image on the sheet P is fixed as a fixed image. After passing through the fixing unit 16, the sheet P is discharged to a discharge tray 22 by a discharge roller 21.

If the fixing roller 16*a* and the pressure roller 16*b* remain abutted against each other for an extended period of time, the elastic material layer of the pressure roller 16*b* may become partly deformed, thereby failing to return to its original state. The pressure roller 16*b*, if rotated in this state, will cause transfer irregularities. To prevent this, a pressure-roller separating mechanism described later (FIGS. 2, 3A, and 3B) is installed. The fixing unit 16 functions as one of processing units.

Figure 2:
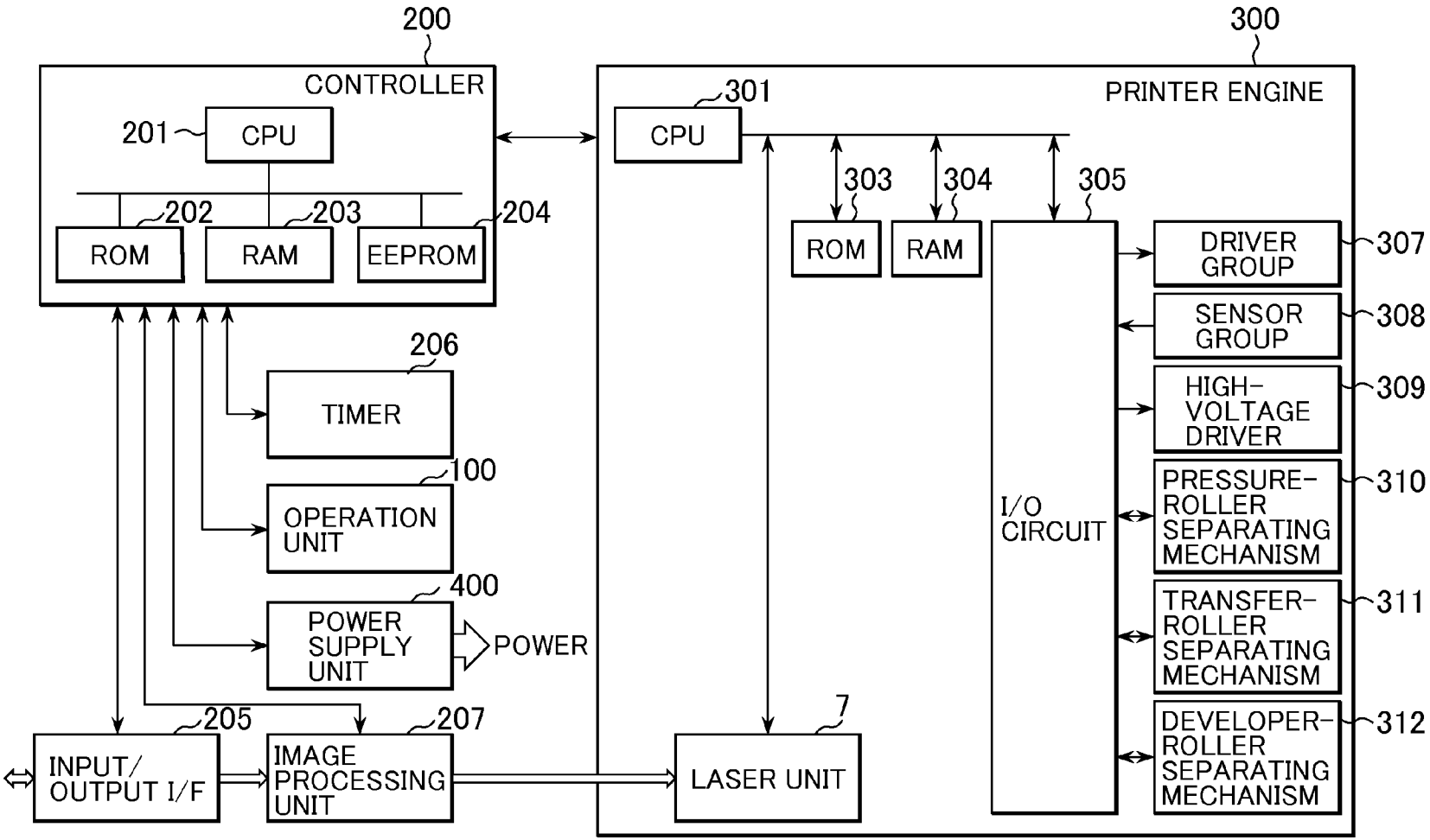
FIG. 2 is a block diagram showing a control configuration of the image forming apparatus of FIG. 1.

Next, a control configuration of the image forming apparatus according to the present embodiment will be described with reference to FIG. 2. FIG. 2 is a block diagram showing the control configuration of the image forming apparatus of FIG. 1.

As shown in FIG. 2, the image forming apparatus is comprised of a controller 200, an input/output interface (input/output I/F) 205, a timer 206, an image processing unit 207, an operation unit 100, a printer engine 300, and a power supply unit 400.

The controller 200 includes a CPU 201, a ROM 202, a RAM 203, and an EEPROM 204. The CPU 201 controls the input/output interface 205, the timer 206, the image processing unit 207, the operation unit 100, the printer engine 300, and the power supply unit 400 according to control programs and information stored in the ROM 202 and the EEPROM 204. The EEPROM 204 stores information such as separation information described later. The RAM 203 provides a working area for the CPU 201.

The input/output interface 205 receives data from an external apparatus such as a personal computer (hereinafter referred to as a PC) and transmits information to the PC.

The timer 206 counts elapsed time after the end of an image forming operation. Operation of the timer 206 is controlled by the controller 200 (CPU 201).

The image processing unit 207 performs predetermined image processing on data received from the PC and thereby converts the data into image data (Y, M, C, Bk image data) processable by the printer engine 300. The image data resulting from the conversion by the image processing unit 207 is outputted to the laser unit 7 of the printer engine 300.

The operation unit 100 has a plurality of keys (not shown) for various settings as well as a liquid crystal display panel (not shown). The plurality of keys includes a power-save-start key used to start a power-save mode and an power-save-cancel key used to cancel the power-save mode. The liquid crystal display panel displays apparatus conditions and various settings. Settings made by the user by operating the keys on the operation unit 100 are sent to the controller 200.

The printer engine 300 drives various drive units to form an image corresponding to image data from the image processing unit 207 on sheet.

Specifically, the printer engine 300 includes a CPU 301, a ROM 303, a RAM 304, an I/O circuit 305, and a laser unit 7. Based on instructions from the controller 200 (CPU 201), the CPU 301 executes an appropriate program read out of the ROM 303 and thereby controls image forming operations. In controlling the operations, the CPU 301 uses the RAM 304 as a working area.

The I/O circuit 305 is an interface which controls input and output with respect to a driver group 307, a sensor group 308, a high-voltage driver 309, a pressure-roller separating mechanism 310, a transfer-roller separating mechanism 311, and a developer-roller separating mechanism 312.

The driver group 307 includes motor drivers which drive motors for the sheet feed roller, a transfer roller, the pressure roller 16*b* of the fixing unit 16, and the like; drivers which drive clutches, solenoids, and the like; and other drivers. The drivers in the driver group 307 drive respective motors, clutches, and solenoids based on a control signal from the CPU 301.

The sensor group 308 includes various sensors such as sheet sensors which detect presence or absence of sheet P on a sheet path and toner sensors which detect amounts of toner in the developing unit 4. The sensor group 308 also includes position sensors which detect home positions of loads such as motors as well as sensors which detect open or closed status of doors. Output from the various sensors of the sensor group 308 is inputted in the CPU 301 via the I/O circuit 305.

The high-voltage driver 309 generates various high voltages including charging bias of the primary chargers 3, developing bias of the developing unit 4, and transfer voltage of the transfer rollers 5 based on a control signal from the CPU 301.

The pressure-roller separating mechanism 310 moves the pressure roller 16*b* selectively to an abutting position where the pressure roller 16*b* abuts the fixing roller 16*a* or a separating position where the pressure roller 16*b* is separated from the fixing roller 16*a*. The fixing roller 16*a* is a first element and the pressure roller 16*b* is a second element. At the abutting position, the pressure roller 16*b* is pressed against the fixing roller 16*a* with a predetermined pressing force. Alternatively, a mechanism which moves the fixing roller 16*a* with respect to the pressure roller 16*b* may be used.

The transfer-roller separating mechanism 311 moves the transfer roller 5 selectively to an abutting position where the transfer roller 5 abuts the photosensitive drum 2 or a separating position where the transfer roller 5 is separated from the photosensitive drum 2. At the abutting position, the transfer rollers 5 are pressed against the respective photosensitive drums 2 via the intermediate transfer belt 9.

The developer-roller separating mechanism 312 moves the developing unit 4 out of abutment and into a separating position where the developer roller of the developing unit 4 is separated from the photosensitive drum 2. The developer-roller separating mechanism 312 can also move the developing unit 4 from the separating position to the abutting position. At the abutting position, the developing unit 4 is held in such a way that the developer roller abut the photosensitive drum 2 (that clearance between the developer roller and photosensitive drum 2 will be very small).

The power supply unit 400 supplies appropriate power to the controller 200, the operation unit 1007 and the printer engine 300 based on a power supply mode set by the controller 200. Available power supply modes include a normal power supply mode, a power-save mode, and a partial power supply mode.

The normal power supply mode is used to supply appropriate power to each of the controller 200, the operation unit 100, and the printer engine 300 for an image forming operation. Incidentally, the normal power supply mode includes power supply conditions in a standby state waiting for image formation to start.

The power-save mode is used to supply power to minimum part necessary for operation of the image forming apparatus in order to minimize power consumption of the image forming apparatus. Specifically, in the power-save mode, power is supplied only to the controller 200, the input/output interface 205, and the timer 206. Incidentally, the controller 200 can recognize key inputs entered via the operation unit 100 even in the power-save mode.

The partial power supply mode is used to supply at least the power needed for the pressure-roller separating mechanism 310, the transfer-roller separating mechanism 311, and the developer-roller separating mechanism 312 to perform separation operations. Specifically, in the partial power supply mode, power is supplied to motors (driving sources) of the printer engine's (300) CPU 301, the pressure-roller separating mechanism 310, the transfer-roller separating mechanism 311, and the developer-roller separating mechanism 312. Also, in the partial power supply mode, power continues to be supplied to the controller 200, input/output interface 205, and timer 206.

In the normal power supply mode, the controller 200 monitors elapsed time t counted by the timer 206 starting from the end of an image forming operation and monitors whether a power-save-start command is inputted (the power-save-start key is pressed) by the user via the operation unit 100. When the elapsed time t exceeds a first set time t1 or the power-save-start command is inputted via the operation unit 100, the controller 200 makes the power supply unit 400 switch to the power-save mode.

Also, in the power-save mode, when the elapsed time t exceeds a second set time t2 (>t1), the controller 200 puts the image forming apparatus in the partial power supply mode in order to activate the separating mechanisms described above. Alternatively, the partial power supply mode may be started after entry into the power-save mode based on comparison between the elapsed time t and a third set time t3. The third set time t3 may be, for example, t3=t2−t1, but the present invention is not limited to this. The controller 200 sends instructions to the CPU 301 of the printer engine 300 to move the pressure roller 16*b*, the transfer roller 5, and the developing unit 4 to their respective separating positions. Upon receiving the instructions, the CPU 301 drives the respective motors of the separating mechanisms via the I/O circuit 305 to move the pressure roller 16*b*, the transfer roller 5, and the developing unit 4 to their respective separating positions.

When the pressure roller 16*b*, the transfer roller 5, and the developing unit 4 are moved to their respective separating positions, the controller 200 makes the power supply unit 400 cancel the partial power supply mode and maintain the power-save mode again.

Also, in the power-save mode, the controller 200 monitors whether the input/output interface 205 receives data from the PC and whether an power-save-cancel command is inputted (the power-save-cancel key is pressed) by the user via the operation unit 100. When the input/output interface 205 receives data from the PC or the power-save-cancel command is inputted, the controller 200 makes the power supply unit 400 switch from power-save mode to normal power supply mode. In this case, the pressure roller 16*b*, the transfer roller 5, and the developing unit 4 may have been moved to their separating positions. Thus, with reference to the separation information stored in the EEPROM 204, the controller 200 sends instructions to the CPU 301 of the printer engine 300 to move the pressure roller 16*b*, transfer roller 5, and developing unit 4 to their abutting positions using the respective separating mechanisms. The separation information here indicate whether the pressure roller 16*b*, the transfer roller 5, and the developing unit 4 are located at their separating positions or abutting positions, respectively.

Figure 3A:
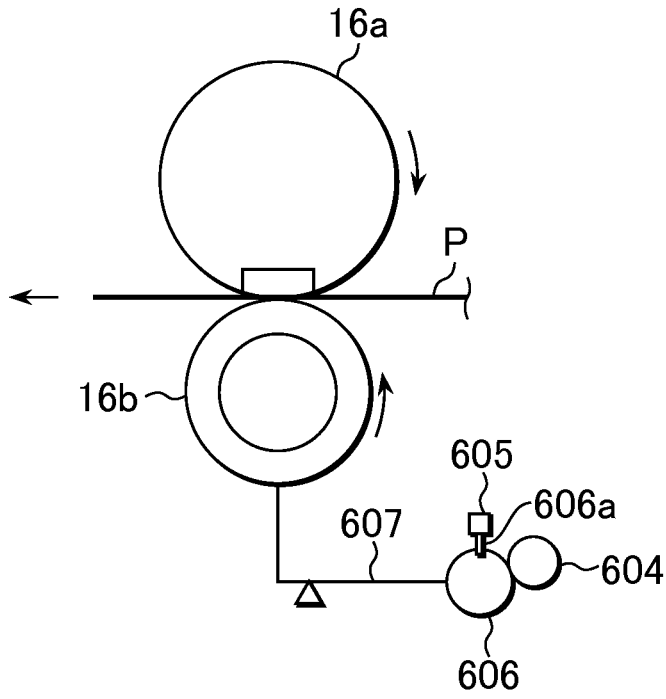
FIG. 3A is a diagram schematically showing a configuration of a pressure-roller separating mechanism 310 in FIG. 2.
Figure 3B:
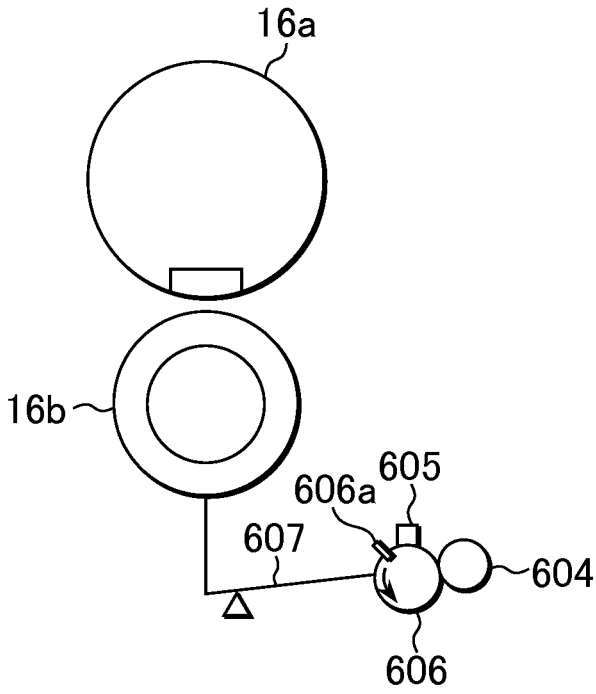
FIG. 3B is a diagram showing a pressure roller 16*b* separated from a fixing roller 16*a* by the pressure-roller separating mechanism 310 in FIG. 3A.

Next, a configuration of the pressure-roller separating mechanism 310 will be described with reference to FIGS. 3A and 3B. FIG. 3A is a diagram schematically showing the configuration of the pressure-roller separating mechanism 310 in FIG. 2. FIG. 3B is a diagram showing the pressure roller 16*b* separated from the fixing roller 16*a* by the pressure-roller separating mechanism 310 in FIG. 3A.

As shown in FIG. 3A, the pressure-roller separating mechanism 310 has a lift cam 606, a moving member 607, a motor 604, and a photosensor 605. The lift cam 606 is rotated by the motor 604. Following the rotation of the lift cam 606, the moving member 607 moves the pressure roller 16*b* to an abutting position where the pressure roller 16*b* abuts the fixing roller 16*a* or a separating position where the pressure roller 16*b* is separated from the fixing roller 16*a*.

The lift cam 606 is provided with a reference member 606*a*. The photosensor 605 is disposed at such a position as to detect the reference member 606*a* when the lift cam 606 is rotated to a position corresponding to the abutting position. Upon detecting the reference member 606*a* of the lift cam 606, the photosensor 605 outputs a detection signal to the CPU 301.

The CPU 301 drives the motor 604 based on the detection signal from the photosensor 605 (a signal about detection of the reference member 606*a* of the lift cam 606 by the photosensor 605).

Specifically, when the reference member 606*a* of the lift cam 606 is located at a position (which corresponds to the abutting position) where the reference member 606*a* can be detected by the photosensor 605, the pressure roller 16*b* is in abutment with the fixing roller 16*a*, having been moved to the abutting position by the moving member 607. At this time, based on the detection signal from the photosensor 605, the CPU 301 determines that the pressure roller 16*b* is in abutment with the fixing roller 16*a*.

To move the pressure roller 16*b* out of abutment with the fixing roller 16*a*, the CPU 301 rotates the motor 604 in a forward direction by a predetermined amount of driving. The predetermined amount of driving is the amount required to move the pressure roller 16*b* from the abutting position to the separating position. Consequently, as shown in FIG. 3B, the lift cam 606 is rotated, and the moving member 607 which follows the rotation of the lift cam 606 moves the pressure roller 16*b* to the separating position, separating the pressure roller 16*b* from the fixing roller 16*a*.

On the other hand, to bring the pressure roller 16*b* separated from the fixing roller 16*a* into abutment with the fixing roller 16*a* again, the CPU 301 rotates the motor 604 in a reverse direction by the predetermined amount of driving. Consequently, the lift cam 606 is rotated, and the pressure roller 16*b* is moved by the moving member 607 toward the abutting position where the pressure roller 16*b* abuts the fixing roller 16*a*. When the reference member 606*a* of the lift cam 606 reaches the position corresponding to the abutting position, the photosensor 605 detects the reference member 606*a* of the lift cam 606 and outputs a detection signal to the CPU 301. Based on the detection signal, the CPU 301 determines that the pressure roller 16*b* has abutted the fixing roller 16*a*, and stops the motor 604.

Figure 4A:
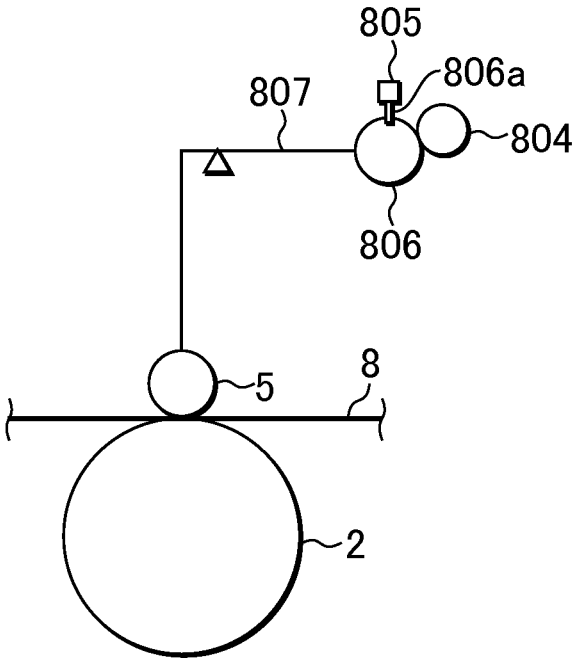
FIG. 4A is a diagram schematically showing a configuration of a transfer-roller separating mechanism 311 in FIG. 2.
Figure 4B:
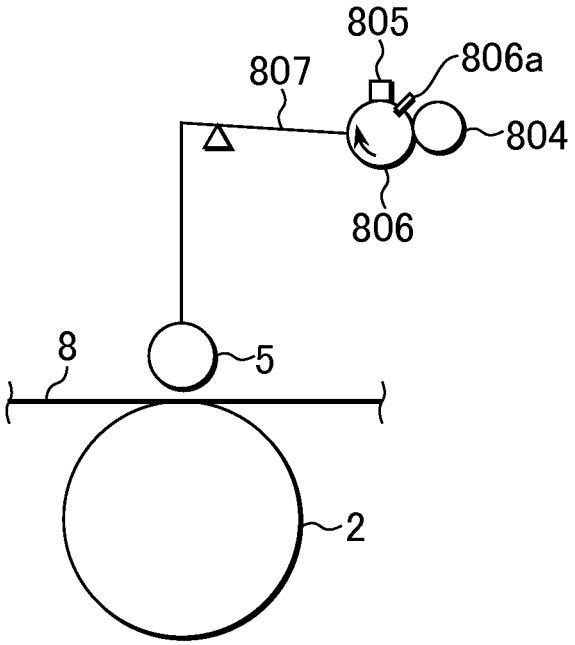
FIG. 4B is a diagram showing a transfer roller 5 separated from a photosensitive drum 2 by the transfer-roller separating mechanism 311 in FIG. 2.

Next, a configuration of the transfer-roller separating mechanism 311 will be described with reference to FIGS. 4A and 4B. FIG. 4A is a diagram schematically showing the configuration of the transfer-roller separating mechanism 311 in FIG. 2. FIG. 4B is a diagram showing the transfer roller 5 separated from the photosensitive drum 2 by the transfer-roller separating mechanism 311 in FIG. 2.

As shown in FIG. 4B, the transfer-roller separating mechanism 311 has a lift cam 806, a moving member 807, a motor 804, and a photosensor 805. The lift cam 806 is rotated by the motor 804. Following the rotation of the lift cam 806, the moving member 807 moves the transfer roller 5 to an abutting position where the transfer roller 5 abuts the photosensitive drum 2 via the intermediate transfer belt 8 or a separating position where the transfer roller 5 is separated from the photosensitive drum 2.

The lift cam 806 is provided with a reference member 806*a*. The photosensor 805 is disposed at such a position as to detect the reference member 806*a* when the lift cam 806 is rotated to a position corresponding to the abutting position. Upon detecting the reference member 806*a* of the lift cam 806, the photosensor 805 outputs a detection signal to the CPU 301.

The CPU 301 drives the motor 804 based on the detection signal from the photosensor 805 (a signal about detection of the reference member 806*a* of the lift cam 806 by the photosensor 805).

Specifically, when the reference member 806*a* of the lift cam 806 is located at a position where the reference member 806*a* can be detected by the photosensor 805, the transfer roller 5 is in abutment with the photosensitive drum 2 via the intermediate transfer belt 8, having been moved to the abutting position. At this time, based on the detection signal from the photosensor 805, the CPU 301 determines that the transfer roller 5 is in abutment with the photosensitive drum 2 via the intermediate transfer belt 8.

To separate the transfer roller 5 from the photosensitive drum 2, the CPU 301 rotates the motor 804 in a forward direction by a predetermined amount of driving. The predetermined amount of driving by the motor 804 is the amount required to move the transfer roller 5 from the abutting position to the separating position. Consequently, as shown in FIG. 4B, the lift cam 806 is rotated, and the moving member 807 which follows the lift cam 806 moves the transfer roller 5 to the separating position, separating the transfer roller 5 from the photosensitive drum 2.

On the other hand, to return the transfer roller 5 from the separating position to the abutting position, the CPU 301 rotates the motor 804 in a reverse direction by the predetermined amount of driving. Consequently, the lift cam 806 is rotated, and the transfer roller 5 is moved by the moving member 807, which follows the lift cam 806, toward the abutting position. When the transfer roller 5 reaches the position corresponding to the abutting position, the photosensor 805 detects the reference member 806*a* of the lift cam 806 and outputs a detection signal to the CPU 301. Based on the detection signal, the CPU 301 determines that the transfer roller 5 has abutted the photosensitive drum 2, and stops the motor 804.

Figure 5A:
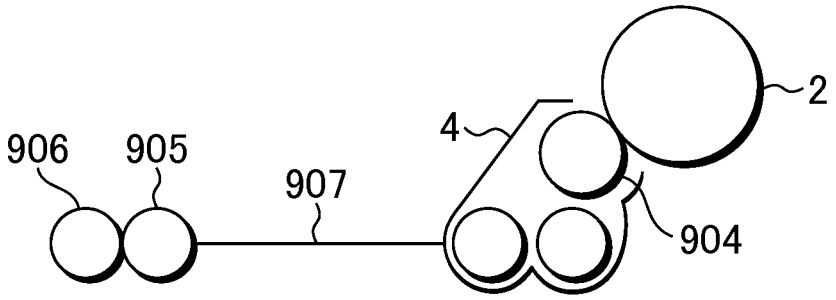
FIG. 5A is a diagram schematically showing a configuration of a developing roller separating mechanism 312 in FIG. 2.
Figure 5B:
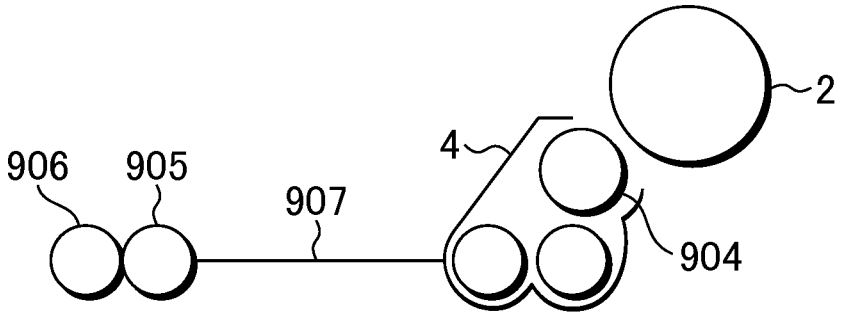
FIG. 5B is a diagram showing a developing roller 904 (developing unit 4) separated by the developing roller separating mechanism 312 in FIG. 2.

Next, a configuration of the developer-roller separating mechanism 312 will be described with reference to FIGS. 5A and 5B. FIG. 5A is a diagram schematically showing the configuration of the developer-roller separating mechanism 312 in FIG. 2. FIG. 5B is a diagram showing the developer roller 904 (developing unit 4) separated by the developer-roller separating mechanism 312 in FIG. 2. As described above, normally the developing unit 4 is held by a moving member 907 at the abutting position where the developer roller 904 abuts the photosensitive drum 2 (where the developer roller and photosensitive drum 2 are held with a very small clearance). The developer-roller separating mechanism 312 moves the developing unit 4 out of the abutment caused by the moving member 907 and into a separating position where the developer roller 904 is separated from the photosensitive drum 2.

As shown in FIG. 5A, the developer-roller separating mechanism 312 has a cam 905, a moving member 907, and a motor 906. The cam 905 is rotated by the motor 906. Following the rotation of the cam 905, the moving member 907 moves in such a way as to bring the developing unit 4 nut of abutment and thereby moves the developing unit 4 to the separating position. Conversely, by moving the moving member 907 through rotation of the cam 905, it is possible to return the developing unit 4 to the abutting position.

To move the developing unit 4 out of the abutment caused by the moving member 907, the CPU 301 rotates the motor 906 in a forward direction by a predetermined amount of driving. The predetermined amount of driving by the motor 906 is the amount required to move the developing unit 4 from the abutting position to the separating position. Movement of the moving member 907 brings the developing unit 4 out of abutment. Then, as shown in FIG. 5B, the developing unit 4 is moved to the separating position where the developer roller 904 is separated from the photosensitive drum 2.

On the other hand, to return the developing unit 4 to the abutting position using the moving member 907, the CPU 301 rotates the motor 906 in a reverse direction by the predetermined amount of driving. Consequently, the cam 905 is rotated, moving the moving member 907. With the movement of the moving member 907, the developing unit 4 is returned to the abutting position, bringing the developer roller 904 into abutment with the photosensitive drum 2.

Figure 6:
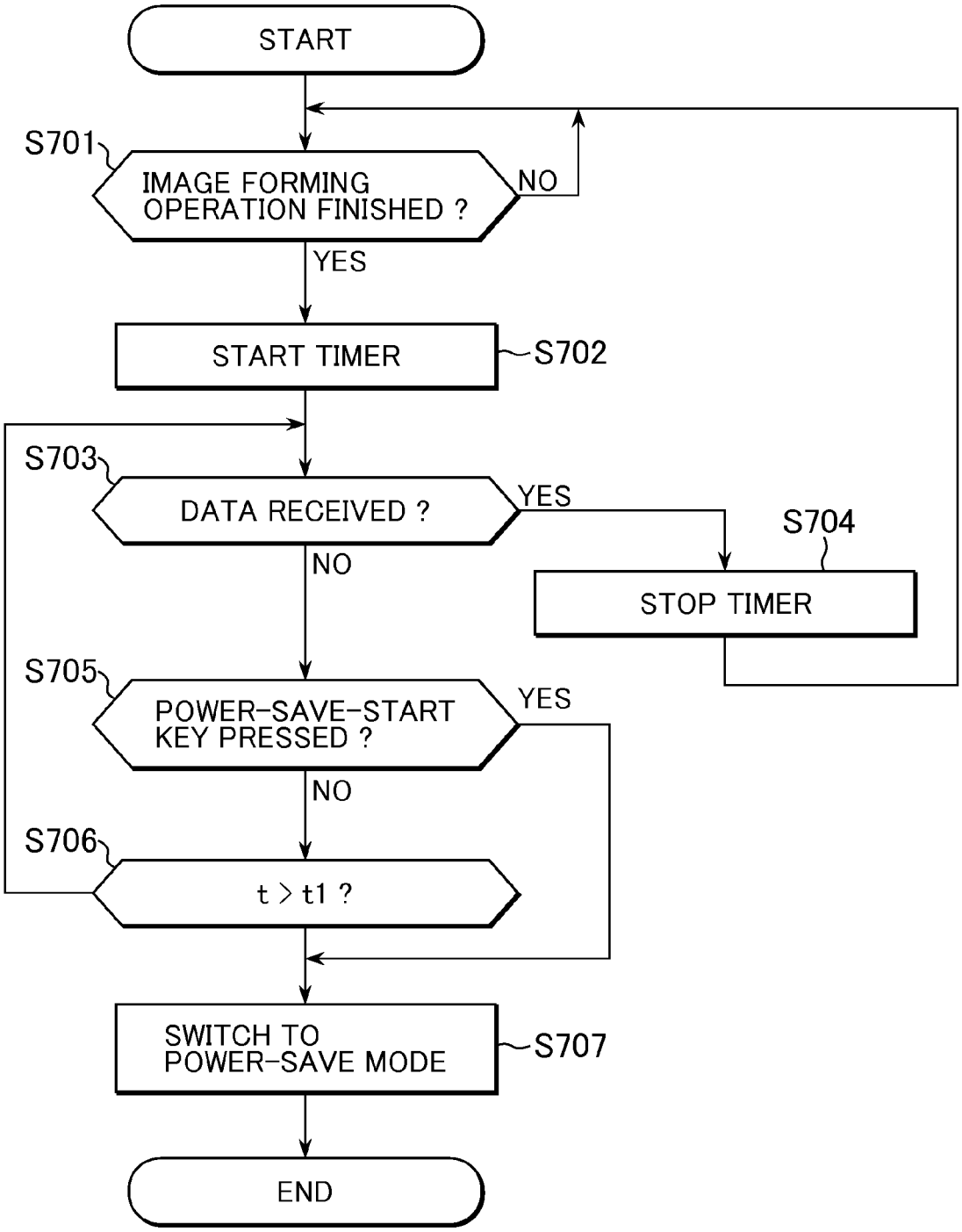
FIG. 6 is a flowchart showing the procedure of a control process executed by a controller 200 in FIG. 2 in normal power supply mode.
Figure 7:
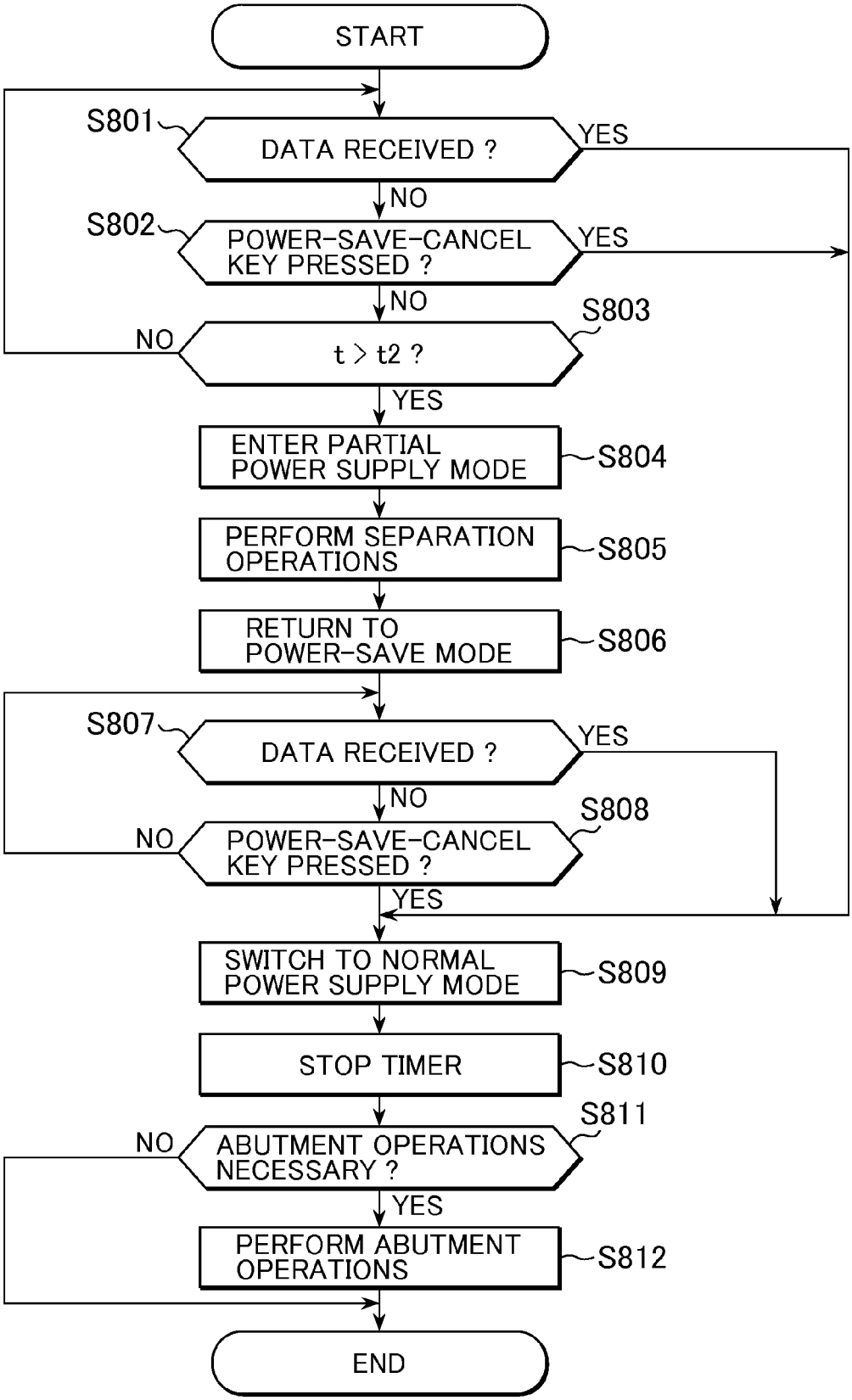
FIG. 7 is a flowchart showing the procedure of a control process executed by the controller 200 in FIG. 2 in power-save mode.

Next, control performed by the controller 200 (CPU 201) will be described with reference to FIGS. 6 and 7, including switching control of the power supply modes and control over the pressure-roller separating mechanism 310, transfer-roller separating mechanism 311, and developer-roller separating mechanism 312. FIG. 6 is a flowchart showing the procedure of a control process executed by the controller 200 in FIG. 2 in normal power supply mode. FIG. 7 is a flowchart showing the procedure of a control process executed by the controller 200 shown in FIG. 2 in power-save mode. The procedures described in the flowcharts in FIGS. 6 and 7 are executed by the CPU 201 of the controller 200 according to the program stored in the ROM 202.

In the normal power supply mode, as shown in FIG. 6, first the controller 200 determines whether or not an image forming operation is finished (step S701). If it is determined that the image forming operation is not finished, the process returns to the step S701. On the other hand, if it is determined that the image forming operation is finished, the controller 200 starts the timer 206 (step S702). The timer 206 starts counting elapsed time t from the end of the image forming operation.

Next, the controller 200 determines whether or not the input/output interface 205 has received data from the PC (step S703). If it is determined that the input/output interface 205 has received data from the PC, the controller 200 stops the timer 206 and clears the elapsed time t (step S704). Then, the process returns to the step S701.

If it is determined in the step S703 that the input/output interface 205 has not received data from the PC, the controller 200 determines whether or not the power-save-start key on the operation unit 100 has been pressed (step S705). If it is determined that the power-save-start key has not been pressed, the controller 200 determines whether or not the elapsed time t counted by the timer 206 has exceeded a first set time t1 (step S706). If it is determined that the elapsed time t has not exceeded the first set time t1, the process returns to the step S703.

If it is determined in the step S705 that the power-save-start key has been pressed, the controller 200 determines that a power-save-start command is inputted by the user. Thus, the controller 200 makes the power supply unit 400 switch from normal power supply mode to power-save mode (step S707). Consequently, the image forming apparatus changes to the power-save mode in which the power supply unit 400 supplies power only to the controller 200, the input/output interface 205, and the timer 206.

If it is determined in the step S706 that the elapsed time t has exceeded the first set time t1, the controller 200 makes the power supply unit 400 switch to power-save mode, as when the power-save-start key is pressed (step S707), the followed by terminating the process.

Once in power-save mode, the controller 200 executes the procedure of the control process described in the flowchart in FIG. 7. Specifically, in the power-save mode, the controller 200 determines whether or not the input/output interface 205 has received data from the PC (step S801). If it is determined that the input/output interface 205 has not received data from the PC, the controller 200 determines whether or not the power-save-cancel key on the operation unit 100 has been pressed (step S802). If it is determined that the power-save-cancel key has not been pressed, the controller 200 determines whether or not the elapsed time t counted by the timer 206 has exceeded a second set time t2 (step S803). If it is determined that the elapsed time t has not exceeded the second set time t2, the process returns to the step S801.

If it is determined in the step S801 that the input/output interface 205 has received data from the PC, the controller 200 makes the power supply unit 400 switch from power-save mode to normal power supply mode (step S809). Then, the controller 200 stops the timer 206 and clears the elapsed time t (step S810).

Next, with reference to the separation information stored in the EEPROM 204, the controller 200 determines whether or not it is necessary to move the pressure roller 16*b*, the transfer roller 5, and the developing unit 4 (developer roller 904) to their respective abutting positions (step S811). In this case, since data has been received before the elapsed time t exceeds the second set time t2, the pressure roller 16*b*, the transfer roller 5, and the developing unit 4 are not separated. That is, the separation information indicates that the pressure roller 16*b*, the transfer roller 5, and the developing unit 4 are located at their respective abutting positions. Thus, the controller 200 determines that there is no need to move the pressure roller 16*b*, transfer roller 5, and developing unit 4 to their respective abutting positions. Also, the controller 200 makes the image processing unit 207 and the printer engine 300 start an image forming operation based on the received data, followed by terminating the process.

If it is determined in the step S802 that the power-save-cancel key has been pressed, the controller 200 determines that a power-save-cancel command is inputted by the user. Consequently, the controller 200 makes the power supply unit 400 switch from a power-save mode to normal power supply mode (step S809). Then, the controller 200 stops the timer 206 (step S810).

Next, with reference to the separation information stored in the EEPROM 204, the controller 200 determines whether or not it is necessary to move the pressure roller 16*b*, the transfer roller 5, and the developing unit 4 to their respective abutting positions (step S811). In this case, since the power-save-cancel key has been pressed before the elapsed time t exceeds the second set time t2, the pressure roller 16*b*, the transfer roller 5, and the developing unit 4 are not separated. That is, the separation information indicates that the pressure roller 16*b*, the transfer roller 5, and the developing unit 4 are located at their respective abutting positions. Thus, the controller 200 determines that there is no need to move the pressure roller 16*b*, the transfer roller 5, and the developing unit 4 to their respective abutting positions, followed by terminating the process.

If it is determined in the step S803 that the elapsed time t has exceeded the second set time t2, the controller 200 makes the power supply unit 400 switch from power-save mode to partial power supply mode (step S804). In the partial power supply mode, the printer engine 300 is supplied with power needed for the pressure-roller separating mechanism 310, the transfer-roller separating mechanism 311, and the developer-roller separating mechanism 312 to perform separation operations.

Next, by controlling the printer engine 300, the controller 200 makes the pressure-roller separating mechanism 310, the transfer-roller separating mechanism 311, and the developer-roller separating mechanism 312 perform separation operations (step S805). Specifically, the controller 200 sends instructions to the printer engine 300 to move the pressure roller 16*b*, the transfer roller 5, and the developing unit 4 to their respective separating positions. Based on the instructions, the CPU 301 drives the respective motors 604, 804, and 906 of the separating mechanisms 310, 311, and 312 to move the pressure roller 16*b*, the transfer roller 5, and the developing unit 4 to their respective separating positions.

Once the pressure roller 16*b*, the transfer roller 5, and the developing unit 4 are moved to their respective separating positions by the separating mechanisms 310, 311, and 312, the separation information in the EEPROM 204 is updated by the controller 200 so as to indicate that the pressure roller 16*b*, the transfer roller 5, and the developing unit 4 are located at their respective separating positions.

Then, the controller 200 makes the power supply unit 400 return from the partial power supply mode to the power-save mode (step S806). Thus, after the pressure roller 16*b*, the transfer roller 5, and the developing unit 4 are moved to their respective separating position the power-save mode is maintained.

Next, the controller 200 determines whether or not the input/output interface 205 has received data from the PC (step S807). If it is determined that the input/output interface 205 has not received data from the PC, the controller 200 determines whether or not the power-save-cancel key on the operation unit 100 has been pressed (step S808). If it is determined that the power-save-cancel key has not been pressed, the process returns to step S807 described above.

If it is determined in the step S807 that the input/output interface 205 has received data from the PC, the controller 200 makes the power supply unit 400 switch from power-save mode to normal power supply mode (step S809). Then, the controller 200 stops the timer 206 (step S810).

Next, with reference to the separation information stored in the EEPROM 204, the controller 200 determines whether or not it is necessary to move the pressure roller 16*b*, the transfer roller 5, and the developing unit 4 to their respective abutting positions (step S811). In this case, the pressure roller 16*b*, the transfer roller 5, and the developing unit 4 are separated. That is, the separation information indicates that the pressure roller 16*b*, transfer roller 5, and developing unit 4 are located at their respective separating positions. Thus, the controller 200 determines that it is necessary to move the pressure roller 16*b*, the transfer roller 5, and the developing unit 4 to their respective abutting positions.

Based on results of the determination, by controlling the printer engine 300, the controller 200 makes the pressure-roller separating mechanism 310, transfer-roller separating mechanism 311, and developer-roller separating mechanism 312 perform abutment operations (step S812). Specifically, the controller 200 sends instructions to the printer engine 300 to move the pressure roller 16*b*, the transfer roller 5, and the developing unit 4 to their respective abutting positions. Based on the instructions, the CPU 301 drives the respective motors 604, 804, and 906 of the separating mechanisms 310, 311, and 312 to move the pressure roller 16*b*, the transfer roller 5, and the developing unit 4 to their respective abutting positions.

Once the pressure roller 16*b*, transfer roller 5, and developing unit 4 are moved to their respective abutting positions by the separating mechanisms 310, 311, and 312, the separation information in the EEPROM 204 is updated by the controller 200 so as to indicate that the pressure roller 16*b*, the transfer roller 5, and the developing unit 4 are located at their respective abutting positions.

Also, the controller 200 makes the image processing unit 207 and the printer engine 300 start an image forming operation based on the received data, followed by terminating the process.

If it is determined in the step S808 that the power-save-cancel key has been pressed, the controller 200 makes the power supply unit 400 switch from power-save mode to normal power supply mode (step S809). Then, the controller 200 stops the timer 206 (step S810).

Next, with reference to the separation information stored in the EEPROM 204, the controller 200 determines whether or not it is necessary to move the pressure roller 16*b*, the transfer roller 5, and the developing unit 4 to their respective abutting positions (step S811). In this case, the separation information indicates that the pressure roller 16*b*, the transfer roller 5, and the developing unit 4 are located at their respective separating positions. Thus, the controller 200 determines that it is necessary to move the pressure roller 16*b*, the transfer roller 5, and the developing unit 4 to their respective abutting positions.

Next, based on results of the determination, by controlling the printer engine 300, the controller 200 makes the pressure-roller separating mechanism 310, transfer-roller separating mechanism 311, and developer-roller separating mechanism 312 perform abutment operations (step S812). Consequently, the pressure-roller separating mechanism 310, the transfer-roller separating mechanism 311, and the developer-roller separating mechanism 312 move the pressure roller 16*b*, the transfer roller 5, and the developing unit 4 to their respective abutting positions, respectively. As a result of the movements, the separation information in the EEPROM 204 is updated so as to indicate that the pressure roller 16*b*, transfer roller 5, and developing unit 4 are located at their respective abutting positions, followed by terminating the process.

In the present embodiment, the first set time t1 and the second set time t2 are, for example, 10 minutes and two hours, respectively. However, it is possible to change the first set time t1 to any period of time in accordance with a user operation via the operation unit 100.

The second set time t2 is established taking the following factors into consideration: an acceptable period of abutment after which the elastic material layers of the fixing roller 16*a* and the pressure roller 16*b* held in abutment against each other can recover from deformation; and an acceptable period of abutment after which the elastic material layers of the transfer roller 5 and developing unit 4 can recover from deformation. The second set time t2 is set based on the above factors.

Now, if the life of the lift cam 606, moving member 607, and other components of the pressure-roller separating mechanism 310 is rated at 10,000 operations, an allowable number of shifts into power-save mode will be 50,000 when calculated based on the product life of the image forming apparatus. Thus, if a separation operation is performed after each shift into power-save mode, the life of the components will expire earlier than the life of the image forming apparatus.

Assuming that the life of the components is rated at 10,000 operations, in order for the components to last as long as the image forming apparatus, it is necessary to set the time allowed before a shift into power-save mode (first set time t1) to about 10 minutes. Thus, considering the life of the components and the acceptable period of abutment after which the elastic material layers can recover from deformation, the second set time t2 is set to 2 hours.

According to the present embodiment, it is possible to reduce the number of times the pressure roller 16*b* is separated from the fixing roller 16*a* upon entry into power-save mode, to thereby minimize failures of the pressure-roller separating mechanism 310. That is, it is possible to reduce the number of times the components (lift cam 606 and moving member 607) of the pressure-roller separating mechanism 310 come into operation, to thereby minimize failures of the components.

In the present embodiment, although respective separating mechanisms are provided for the fixing unit 16, developing units 4*a* to 4*d*, and transfer rollers 5*a* to 5*d*, the present invention is limited to this, but a separating mechanism may be provided for the secondary transfer roller 12 and may be controlled together with the other separating mechanisms. Alternatively, a separating mechanism may be provided for at least one of the fixing unit 16, developing units 4*a* to 4*d*, the transfer rollers 5*a* to 5*d*, and the secondary transfer roller 12.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2007-224554, filed Aug. 30, 2007, which is hereby incorporated by reference herein in its entirety.

What is claimed is:

1. An image forming apparatus for forming an image on a sheet, the apparatus comprising:

an abutting and separating unit adapted to abut a first rotating body to a second rotating body, and separate the first rotating body from the second rotating body;

a power supply unit adapted to control power supply in the image forming apparatus; and a control unit adapted to cause the image forming apparatus to change to a power-save mode in which power consumption of the image forming apparatus is reduced, and stop power supply from said power supply unit to said abutting and separating unit, wherein said control unit is adapted to:

cause said abutting and separating unit to abut the first rotating body to the second rotating body until an elapsed time after the image forming apparatus has changed to the power-save mode reaches a predetermined time, and to separate the first rotating body from the second rotating body by supplying power from said power supply unit to said abutting and separating unit when the elapsed time after the image forming apparatus has changed to the power-save mode exceeds the predetermined time; and maintain the power-save mode by stopping power supply from said power supply unit to said abutting and separating unit after the first rotating body is separated from the second rotating body.

2. An image forming apparatus as claimed in claim 1, further comprising:

a storage unit adapted to store abutment and separation information which indicates whether the first rotating body is abutting or separated from the second rotating body, wherein when the image forming apparatus is resumed from the power-save mode, said control unit is adapted to control operations of said abutting and separating unit based on the abutment and separation information stored in said storage unit.

3. An image forming apparatus as claimed in claim 2, wherein in a case where the image forming apparatus is resumed from the power-save mode when the abutment and separation information indicates that the first rotating body is separated from the second rotating body, said control unit is adapted to cause said abutting and separating unit to abut the first rotating body to the second rotating body.

4. An image forming apparatus as claimed in claim 1, further comprising:

an operation unit adapted to input an instruction; and a receiving unit adapted to receive image data transmitted from an external apparatus, wherein when image data is received from the external apparatus or an instruction for resuming from the power-save mode is input via said operation unit during the power-save mode, said control unit is adapted to resume from the power-save mode and cause said abutting and separating unit to abut the first rotating body to the second rotating body.

5. An image forming apparatus as claimed in claim 1, wherein said abutting and separating unit includes:

a moving member adapted to move the first rotating body to an abutting position where the first rotating body is abutting the second rotating body, and a separating position where the first rotating body is separated from the second rotating body; and a driving unit adapted to drive said moving member.

6. An image forming apparatus as claimed in claim 1, further comprising:

an image forming unit adapted to form a toner image on a sheet; and a fixing unit adapted to fix the toner image formed on the sheet, said fixing unit including a heating member adapted to heat the toner image and a pressing member adapted to abut the heating member, wherein the first rotating body is the pressing member and the second rotating body is the heating member.

7. An image forming apparatus as claimed in claim 1, further comprising:

an image forming unit adapted to form a toner image on a photosensitive member;

an intermediate transfer body to which the toner image formed on the photosensitive member is transferred; and a transfer roller adapted to abut the photosensitive member via said intermediate transfer body, wherein the first rotating body is the transfer roller and the second rotating body is the intermediate transfer body.

8. An image forming apparatus as claimed in claim 1, further comprising:

a developing unit adapted to attach toner to a photosensitive member, said developing unit including a developer roller adapted to supply toner, wherein the first rotating body is the developer roller and the second rotating body is the photosensitive member.

9. A control method for an image forming apparatus having an abutting and separating unit adapted to abut a first rotating body to a second rotating body, and separate the first rotating body from the second rotating body, and a power supply unit adapted to control power supply in the image forming apparatus, the control method comprising:

a first control step of causing the image forming apparatus to change to a power-save mode in which power consumption of the image forming apparatus is reduced, and stop power supply from the power supply unit to the abutting and separating unit;

a second control step of unit causing the image forming apparatus to abut the first rotating body to the second rotating body until an elapsed time after the image forming apparatus has changed to the power-save mode reaches a predetermined time, and to separate the first rotating body from the second rotating body by supplying power from the power supply unit to the abutting and separating unit when the elapsed time after the image forming apparatus has changed to the power-save mode exceeds the predetermined time; and a third control step of maintaining the power-save mode by stopping power supply from the power supply unit to the abutting and separating unit after the first rotating body is separated from the second rotating body.

10. An image forming apparatus for performing an image forming operation with a first element and a second element to which the first element abuts, the apparatus comprising:

an abutting and separating unit adapted to abut the first element to the second element, and separate the first element from the second element;

a power supply unit adapted to control power supply in the image forming apparatus; and a control unit adapted to cause the image forming apparatus to change to a power-save mode in which power consumption of the image forming apparatus is reduced, and stop power supply from the power supply unit to the abutting and separating unit, wherein said control unit is adapted to:

cause said abutting and separating unit to abut the first element to the second element until an elapsed time after the image forming apparatus has changed to the power-save mode reaches a predetermined time, and to separate the first element from the second element by supplying power from said power supply unit to said abutting and separating unit when the elapsed time after the image forming apparatus has changed to the power-save mode exceeds the predetermined time; and maintain the power-save mode by stopping power supply from said power supply unit to said abutting and separating unit after the first element is separated from the second element.

11. An image forming apparatus for forming an image on a sheet, the apparatus comprising:

an abutting and separating unit adapted to abut a first rotating body to a second rotating body, and separate the first rotating body from the second rotating body;

a power supply unit adapted to control power supply in the image forming apparatus; and a control unit adapted to cause the image forming apparatus to change to a power-save mode in which power consumption of the image forming apparatus is reduced when an elapsed time from an end of an image forming operation of the image forming apparatus exceeds a first predetermined time, and stop power supply from said power supply unit to said abutting and separating unit, wherein said control unit is adapted to:

cause said abutting and separating unit to abut the first rotating body to the second rotating body until an elapsed time from an end of an image forming operation of the image forming apparatus reaches a second predetermined time that is longer than the first predetermined time, and to separate the first rotating body from the second rotating body by supplying power from said power supply unit to said abutting and separating unit when an elapsed time from the end of the image forming operation of the image forming apparatus exceeds the second predetermined time; and maintain the power-save mode by stopping power supply from said power supply unit to said abutting and separating unit after the first rotating body is separated from the second rotating body.

12. An image forming apparatus as claimed in claim 1, wherein one of the first or second rotating body has an elastic material.

13. A control method as claimed in claim 9, wherein one of the first or second rotating body has an elastic material.

14. An image forming apparatus as claimed in claim 11, wherein one of the first or second rotating body has an elastic material.

* * * * *